US007731176B2

(12) United States Patent
Bato-on et al.

(10) Patent No.: US 7,731,176 B2
(45) Date of Patent: Jun. 8, 2010

(54) SHEET PICKING SYSTEM FOR AN IMAGING APPARATUS

(75) Inventors: Jessíe Mondoñdo Bato-on, Mandaue (PH); Gil Alfredo Vargas, Kabankalan (PH)

(73) Assignee: Lexmark Internatinoal, Inc., Lexington, KY (US)

( * ) Notice: Subject to any disclaimer, the term of this patent is extended or adjusted under 35 U.S.C. 154(b) by 15 days.

(21) Appl. No.: 11/746,115

(22) Filed: May 9, 2007

(65) Prior Publication Data

US 2008/0277861 A1 Nov. 13, 2008

(51) Int. Cl.
*B65H 3/06* (2006.01)

(52) U.S. Cl. ..... 271/117; 271/114; 271/115; 271/118; 271/109

(58) Field of Classification Search ..... 271/114, 271/115, 117, 118, 109
See application file for complete search history.

(56) References Cited

U.S. PATENT DOCUMENTS 3,815,900 A * 6/1974 Schulze ..... 271/118
5,193,797 A * 3/1993 Harada et al. ..... 271/115
5,527,026 A 6/1996 Padget et al.
5,697,603 A * 12/1997 Kato ..... 271/114
6,318,715 B1 11/2001 Froechte et al.
6,503,010 B2 * 1/2003 Jeong ..... 400/629
6,648,322 B2 * 11/2003 Park ..... 271/117
7,100,912 B2 * 9/2006 Yun ..... 271/10.11
7,303,189 B2 * 12/2007 Huang et al. ..... 271/118
2004/0141785 A1 * 7/2004 Kang ..... 400/578
2004/0251593 A1 * 12/2004 Liu et al. ..... 271/109
2005/0194733 A1 * 9/2005 Asada ..... 271/117
2005/0275150 A1 * 12/2005 Cook et al. ..... 271/109
2007/0040320 A1 * 2/2007 Huang et al. ..... 271/10.01
2007/0102867 A1 * 5/2007 Leemhuis et al. ..... 271/117
2007/0145670 A1 * 6/2007 Asada ..... 271/117
2007/0200287 A1 * 8/2007 Dax et al. ..... 271/220
2008/0122162 A1 * 5/2008 Bokelman et al. ..... 271/124

* cited by examiner

*Primary Examiner*—Patrick Mackey
*Assistant Examiner*—Prasad V Gokhale

(57) ABSTRACT

A sheet picking system for picking a sheet of media includes a power source having a driveshaft. A first housing arm containing a drive gear is drivably coupled to the driveshaft. The drive gear defines a first pivot axis for the first housing arm, wherein the drive gear is driven by the driveshaft to rotate about the first pivot axis. A second housing arm contains an intermediate gear, a transmission device, and a pick roller. The transmission device is configured to rotatably couple the intermediate gear to the pick roller. The intermediate gear is positioned to be meshed with the drive gear. The intermediate gear defines a second pivot axis for the second housing arm. A link mechanism pivotably couples the first housing arm at the first pivot axis to the second housing arm at the second pivot axis.

21 Claims, 7 Drawing Sheets

SHEET PICKING SYSTEM FOR AN IMAGING APPARATUS

CROSS-REFERENCE TO RELATED APPLICATIONS

None.

MICROFICHE APPENDIX

None.

GOVERNMENT RIGHTS IN PATENT

None.

BACKGROUND OF THE INVENTION

1. Field of the Invention

The present invention relates to an imaging apparatus, sod, more particularly, to sheet picking system for an imaging apparatus.

2. Description of the Related Art

An imaging apparatus, such as a printer, scanner or copier, includes a sheet picking mechanism that is used to successively pick a single sheet of media, e.g., paper, from a media stack. With sheet picking mechanisms there is a critical normal force relationship between the pick roller of the sheet picking mechanism and the media stack. For example, too much normal force will result in feeds of multiple sheets at the same time, whereas too little normal force will result in failures to feed a sheet of media from the media stack. One type of sheet picking mechanism that attempts to overcome these problems includes a gear train, that is pivoted toward the media stack and rotates a drive roller with an increasing normal force being applied to the top sheet, of media until the top sheet of media is moved.

There is critical relationship between the buckling resistance of the sheet of media at the pick roller and the corresponding normal force at the media stack. Therefore, a simultaneous reaction happens between the buckling resistance and normal force at the media stock. In other words, a certain "cycle" exists during the picking process of the media wherein as the resistance in buckling of the media increases there is a corresponding increase in the normal force. This "cycle" can go on and on until either the sheet of media moves, the pick roller slips, or some part of the sheet picking mechanism tails. Also, it has been found that this increase in normal force for the corresponding buckling resistance increases from a media tray having a full media stack to a media tray that is empty. In other words, for the same buckling resistance the corresponding normal force is greater in an empty tray than in full tray causing a failure to pick, particularly in the case of relatively stiff media (e.g. cardstock, envelopes and index cards) at an almost empty tray level.

Because in picking heavier/stiller media the buckling resistance is large, causing a large normal force on the media stack which will increase the frictional resistance force between the top sheet and the next sheet, which in turn requires an increase in the needed torque to move the top media sheet. This action and reaction relationship between the drive force and the normal force may cause the system to fail to pick stiffer/thicker media.

SUMMARY OF THE INVENTION

The present invention provides a sheet picking system that is configured to more reliably pick sillier/thicker media.

The terms "first" and "second" preceding an element name, e.g., first housing arm, second housing arm, etc., are used for identification purposes to distinguish between similar and/or multiple elements of a mechanism, and are not intended to necessarily imply order.

The invention, in one form thereof, is directed to a sheet picking system for picking a sheet of media. Use sheet picking system includes a power source having a driveshaft. A first housing arm containing a drive gear is drivably coupled to the driveshaft. The drive gear defines a first pivot axis for the first housing arm, wherein the drive gear is driven by the driveshaft to rotate about the first pivot axis. A second housing arm contains an intermediate gear, a transmission device, and a pick roller. The transmission device is configured to rotatably couple the intermediate gear to the pick roller. The intermediate gear is positioned to be meshed with the drive gear. The intermediate gear defines a second pivot axis for the second housing arm. A link mechanism pivotably couples the first housing arm at the first pivot axis to the second housing arm at the second pivot axis.

The invention, in another form thereof, is directed to an imaging apparatus. The imaging apparatus includes a media transport system configured to transport a sheet of media, along a sheet feed path. An imaging engine is located along the sheet feed path. A sheet picking system is configured to pick the sheet of media from a media stack and transport, the sheet of media to the media transport system. The sheet picking system includes a power source having a driveshaft. A first housing arm containing a drive gear is drivably coupled to the driveshaft. The drive gear defines a first pivot axis for the first housing arm, wherein, the drive gear is driven by the driveshaft to rotate about the first pivot axis. A second housing arm contains an intermediate gear, a transmission device, and a pick roller. The transmission device is configured to rotatably couple the intermediate gear to the pick roller. The intermediate gear is positioned to be meshed with the drive gear. The intermediate gear defines a second pivot axis for the second housing arm. A link mechanism pivotably couples the first housing arm at the first pivot axis to the second housing arm at the second pivot axis.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF TEE INVENTION

Figure 1:
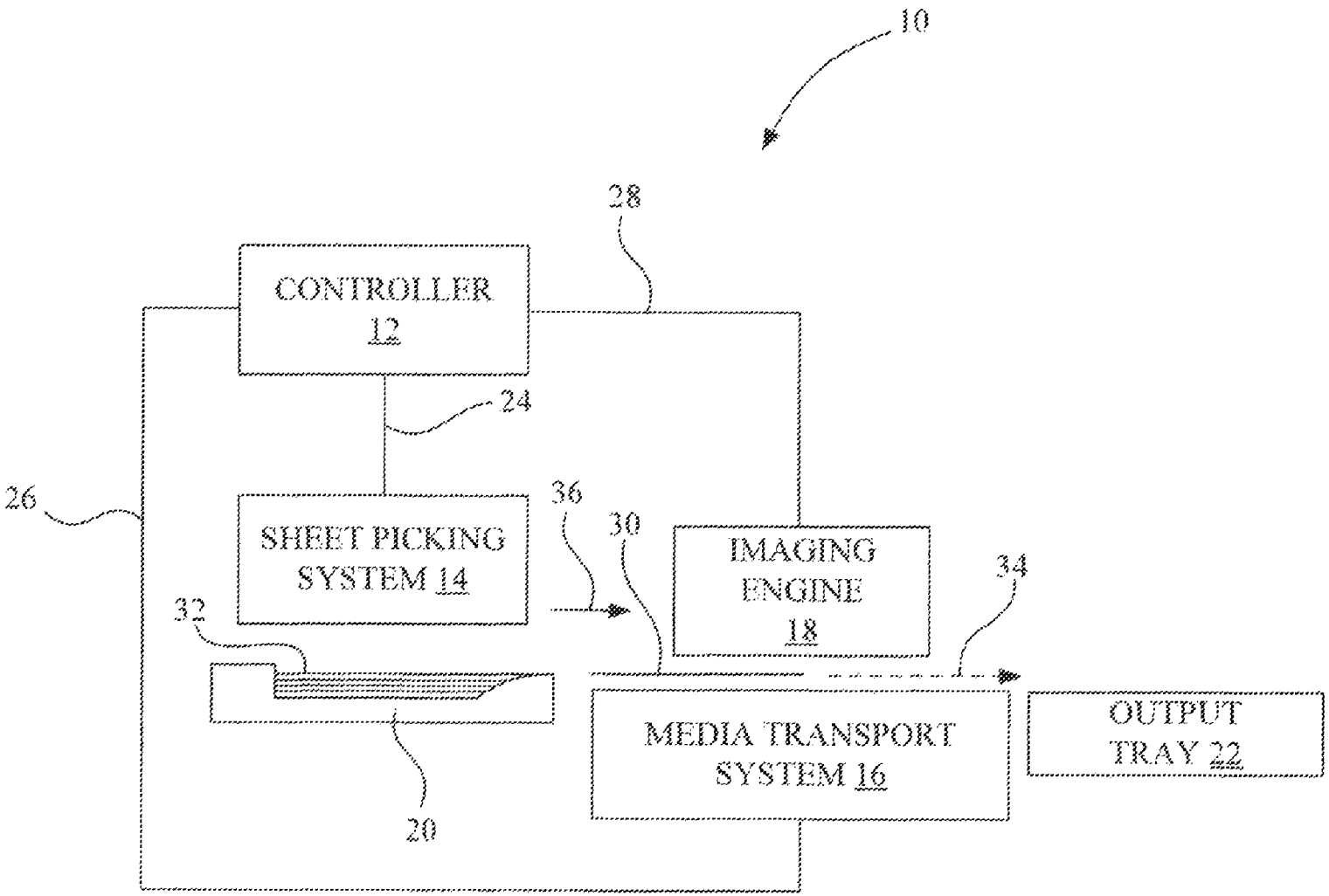
FIG. 1 is a block diagram of an imaging apparatus including a sheet picking system embodying the present invention.

Referring to FIG. 1, there is shown a block diagram of an imaging apparatus 10 embodying the present invention. Imaging apparatus 10 includes a controller 12, a sheet picking system 14, a media transport system 16, an imaging engine 18, a supply tray 20 and an output tray 22.

Controller 12 is communicatively coupled to each of sheet picking system 14, media transport system 16, and imaging engine 18 via communications links 24, 26, and 28, respectively. As used herein, the term "communications link" generally refers to structure that facilitates electronic communication between two components, and may operate using wired or wireless technology. Accordingly, each of communications links 24, 26, 28 may be, for example, one o or a combination of a bus structure, an electrical wired connection, a wireless connection (e.g., infrared or r.f.), or a network connection.

Controller 12 may be, for example, an application specific integrated circuit (ASIC) having programmed and/or programmable processing capabilities. In some embodiments of imaging apparatus 10, such as for example where imaging apparatus 10 is an all-in-one (AIO) unit having printing and copying functionality in addition to scanning functionality, controller 12 may include in its memory a software or firmware program including program instructions that function as a driver for supporting printing and/or scanning functions in conjunction with imaging engine 18.

Sheet picking system 14 is configured to retrieve, i.e., pick, a sheet of media 30, e.g., paper, card-stock, envelopes, index cards, etc., from a media stack 32, and transports the sheet of media 30 along a sheet feed path 34 in sheet feed direction 36 to media transport system 16. The shape of sheet feed path 34 may be, for example, linear, L-shaped, C-shaped, etc., depending on the orientation of supply tray 20, imaging engine 18, and output, tray 22. Imaging engine 18 is located along sheet, feed path 34. Media transport system 16 in turn transports the picked sheet of media 30 along sheet feed path 34 through imaging engine 18, and delivers the media, sheet to output tray 22.

Each of sheet picking system 14 and media transport system 16 include respective associated drive trains and media transport rollers, and a drive source, such, as for example, a direct current (DC) motor or a stepper motor. In one embodiment, for example, sheet picking system 14 and media transport system 16 may share a common motor. However, one skilled in the art will recognize that each of sheet picking system 14 and media transport system 16 may include one or more dedicated motors.

Imaging engine 18 may be configured, for example to facilitate printing and/or scanning functionality. In embodiments supporting a printing function, imaging engine 18 may include an ink jet printing mechanism, or an electrophotographic printing mechanism (e.g., a laser printer), both of which are well known in the art. In embodiments supporting a scanning function. Imaging engine 18 may include a scanning device for scanning a document for generating a digitized image of the document. In embodiments where imaging engine 18 includes both printing and scanning (e.g., copying) functionality, imaging apparatus 10 is what is commonly referred to as a multifunction machine, or all-in-one machine.

Figure 2A:
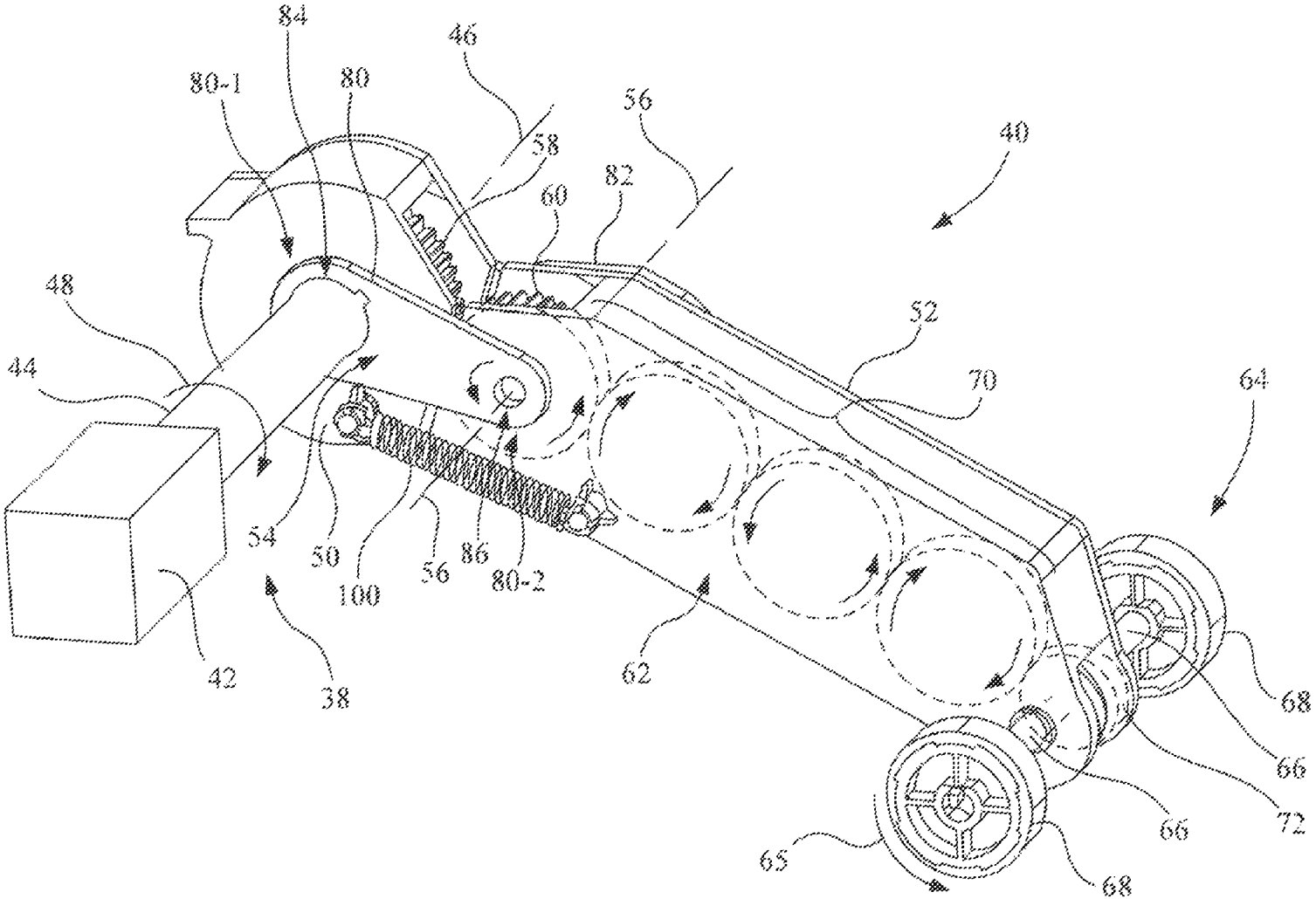
FIGS. 2A and 2B are perspective views of the sheet picking system of the imaging apparatus of FIG. 1 with the second housing arm in the home position relative to the first housing arm.
Figure 2B:
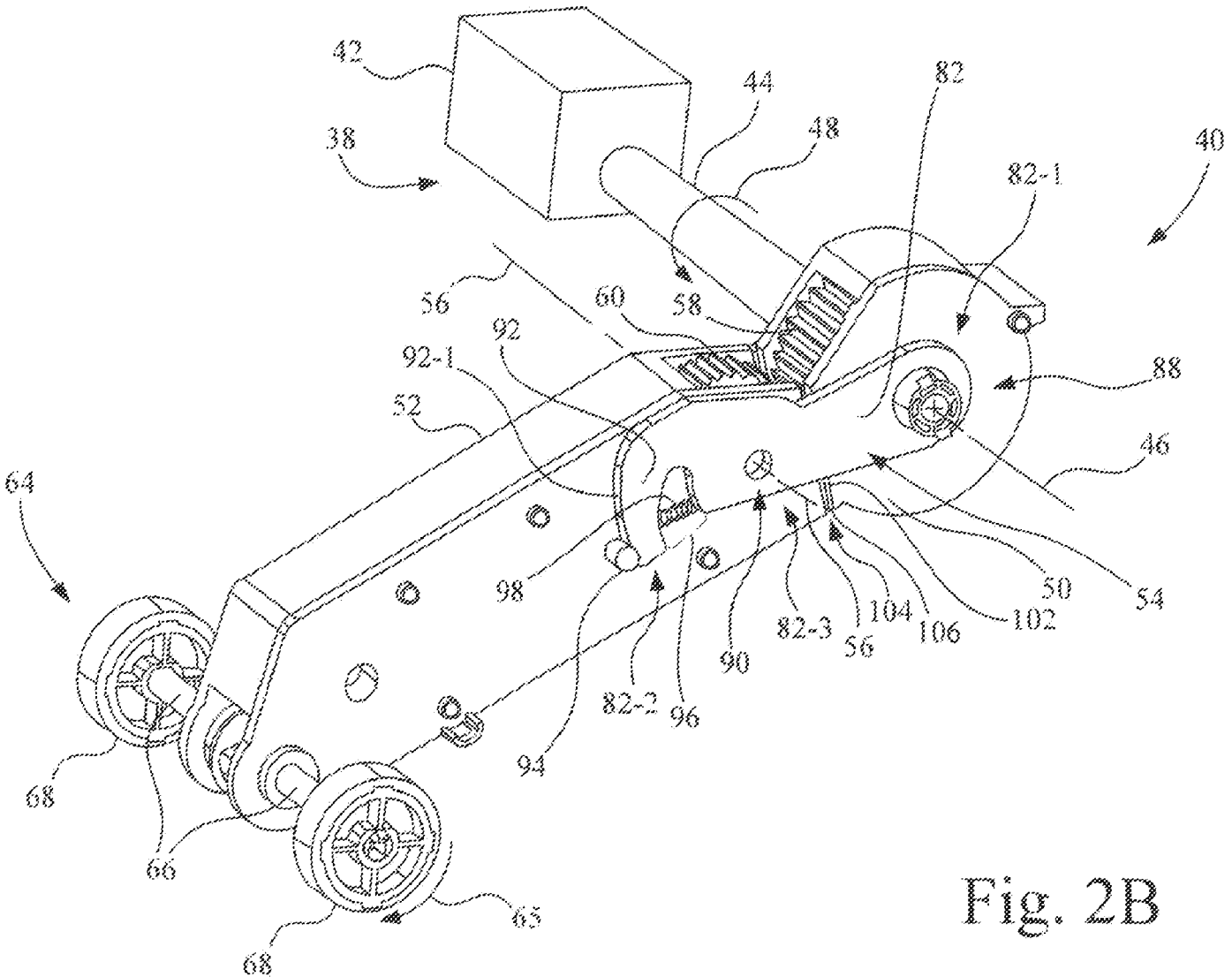

Referring to FIGS. 2A and 2B, there is shown an embodiment of sheet picking system 14. Sheet picking system 14 includes a power source 38 and an auto compensator mechanism 40.

Power source 38 may include, for example, a drive source 42 and a driveshaft 44. A first pivot axis 46 is associated with auto compensator mechanism 40, and in the present embodiment corresponds to the rotational axis of driveshaft 44. Drive source 42 may include, for example, a direct current (DC) motor or stepper motor, and an associated drive train. During a sheet picking operation, drive source 42 rotates driveshaft 44 in rotational direction 48 to provide a rotational motion to auto compensator mechanism 40.

Auto compensator mechanism 40 includes a first housing arm 50, a second housing arm 52 and a link mechanism 54. Link mechanism 54 pivotably couples first housing arm 50 at first pivot, axis 46 to second housing arm 52 at a second pivot axis 56. Second pivot axis 56 is oriented parallel with first pivot axis 46.

First housing arm 50 contains a drive gear 58 drivably coupled to driveshaft 44. In the present embodiment the rotational axis of drive gear 58 corresponds to, and defines, the location of first pivot axis 46 for first housing arm 50. Drive gear 58 is rotatably driven by driveshaft 44 to rotate about first, pivot axis 46.

Second housing arm 52 contains an intermediate gear 60, a transmission device 62, and a pick roller 64. Intermediate gear 60 is positioned to be meshed with drive gear 58, with the rotational axis of intermediate gear 60 corresponding to and defining, the location of second pivot axis 56 associated with second housing arm 52.

Figure 2C:
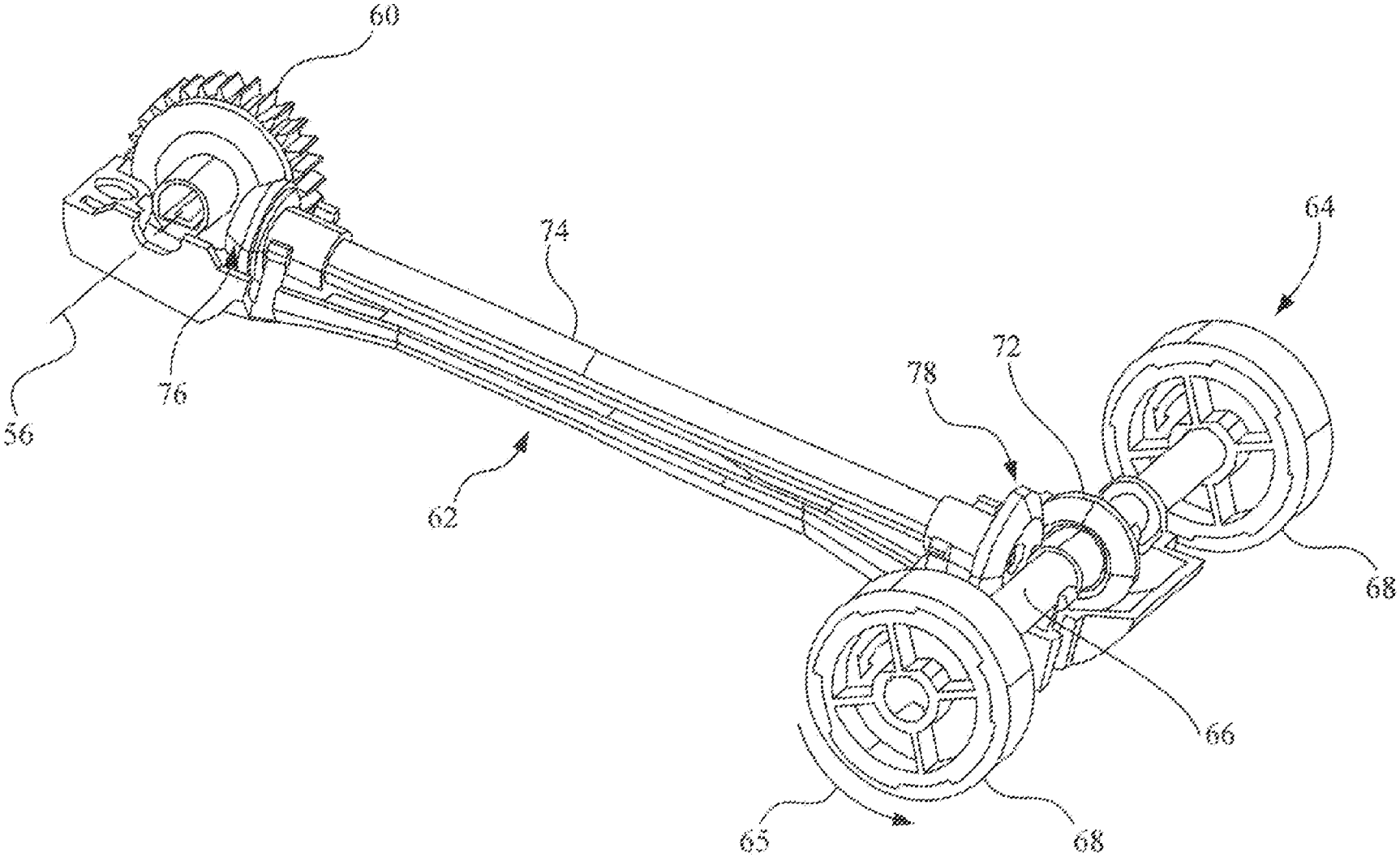
FIG. 2C shows an alternative transmission device to that used in the embodiment of FIGS. 2A and 2B, for coupling rotational force to the pick, roller.

Transmission device 62 is configured to rotatably couple intermediate gear 60 to pick roller 64. A rotation of drive gear 58 in rotational direction 48 results in a rotation of pick roller 64 in a rotational direction 65. Pick roller 64 includes an axle 66 and one or more wheels 68. In the embodiment, shown in FIG. 2A, for example, transmission device 62 may be in the form of a plurality of meshed gears 70, with a final gear 72 driving axle 66 of pick roller 64. Alternatively, as shown in FIG. 2C, transmission device 62 may include an auxiliary driveshaft 74 rotatably coupled by spur/bevel compound gears 76, 78 to intermediate gear 60 and final gear 72, respectively.

Referring again to FIGS. 2A and 2B, in the present embodiment link mechanism 54 includes a first elongate member 80 and a second elongate member 82 to provide the pivot coupling of second housing arm 52 to first housing arm 50. Alternatively, however, it is contemplated link mechanism 54 may be configured using only one elongate member, e.g., elongate member 82, to provide the pivot coupling of second housing arm 52 to first housing arm 50.

First elongate member 80 has a proximal end 80-1 and a distal end 80-2. Second elongate member 82 has a proximal end 82-1, a distal end 82-2, and an intermediate portion 82-3 located between proximal end 82-1 and distal end 82-2. Elongate member 80 forms a pivot joint 84 with first housing arm 50 near proximal end 80-1 at first pivot axis 46, and forms a pivot joint 86 with second housing arm 52 near distal end 80-2 at second pivot axis 56. Second elongate member 82 forms a pivot joint 88 with first housing arm 50 near proximal end 82-1 at first pivot, axis 46, and forms a pivot joint 90 with second housing arm 52 in intermediate portion 82-3 at second pivot axis 56. Each of pivot joints 84, 86, 88 and 90 may be formed, for example, by a pin/hole hinge arrangement, with, the heads of the pins being flared so as to retain first elongate member 80 and second elongate member 82.

Second elongate member 82 defines a cantilever beam 92 located at distal end 82-2. Second housing arm 52 includes a protrusion member 94, such as for example, an outwardly extending pin. Cantilever beam 92 may be formed by a cutout forming a gap 96 between cantilever beam 92 and intermediate portion 82-3 of second elongate member 82. Cantilever beam 92 has a cam surface 92-1. Protrusion member 94 is located to engage cam surface 92-1 and deflect cantilever beam 92 to provide a rotational resistance when second housing arm 52 is pivoted at second pivot axis 56 to aid in noise redaction. Optionally, as shown by dashed lines, a compression spring 98 may be positioned in gap 96 in contact with cantilever beam 92 and intermediate portion 82-3 of elongate member 82 to increase the rotational resistance provided by cantilever beam 92.

Referring to FIG. 2A, a spring 100 is coupled, e.g., by a hook/pin arrangement, to first housing arm 50 and second housing arm 52 to bias second housing arm 52 toward a stop surface 102 (see FIG. 2B) associated with first housing arm 50. Stop surface 102 may be formed, for example, directly on first housing arm 50. Stop surface 102 defines a home position 104 of second housing arm 52 relative to first housing arm 50. Optionally, an elastic dampener 106, e.g., made from rubber, may be located between second housing arm 52 and stop surface 102 to provide noise reduction when second housing arm 52 reaches home position 104.

Figure 3:
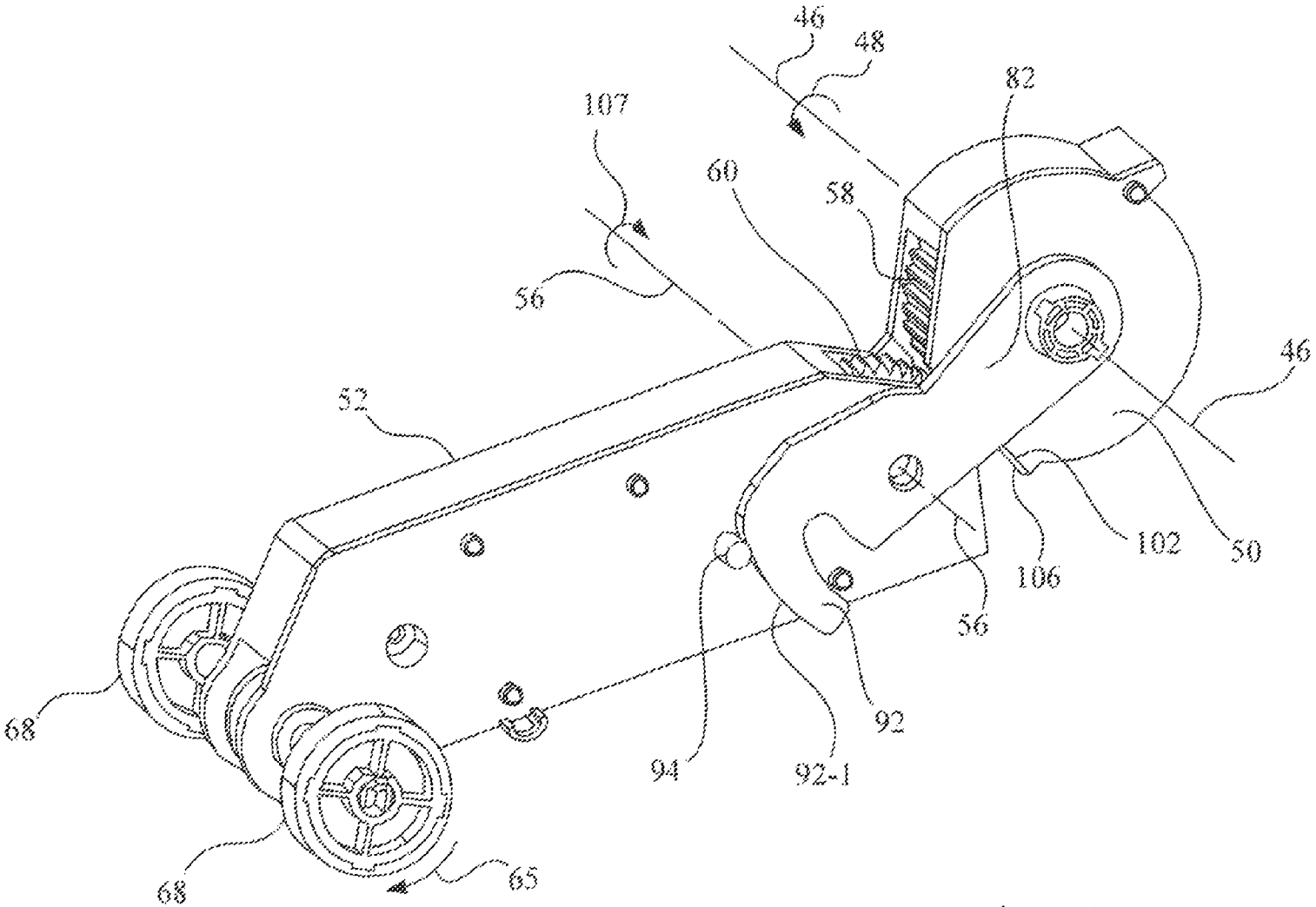
FIG. 3 is a perspective view of the sheet picking system of the imaging apparatus of FIG. 1 with the second housing arm in a non-home position relative to the first housing arm.

Referring to FIG. 3, the locations of first pivot axis 46 and second pivot axis 56 are designed so that second housing arm 52 rotates about second pivot axis 56 in a direction 107 opposite to rotational direction 48 of first housing arm 50 about first pivot axis 46 when the spring force exerted by spring 100 in holding second housing arm 52 in home position 104 is overcome during a sheet picking operation. When spring 100 returns to its non-extended position, i.e., home position 104, (see FIGS. 2A and 2B), the engagement of cantilever beam 92 with protrusion member 94 softens the impact of second housing arm 52 engaging stop surface 102 associated with first housing arm 50, thereby reducing noise.

Figure 4A:
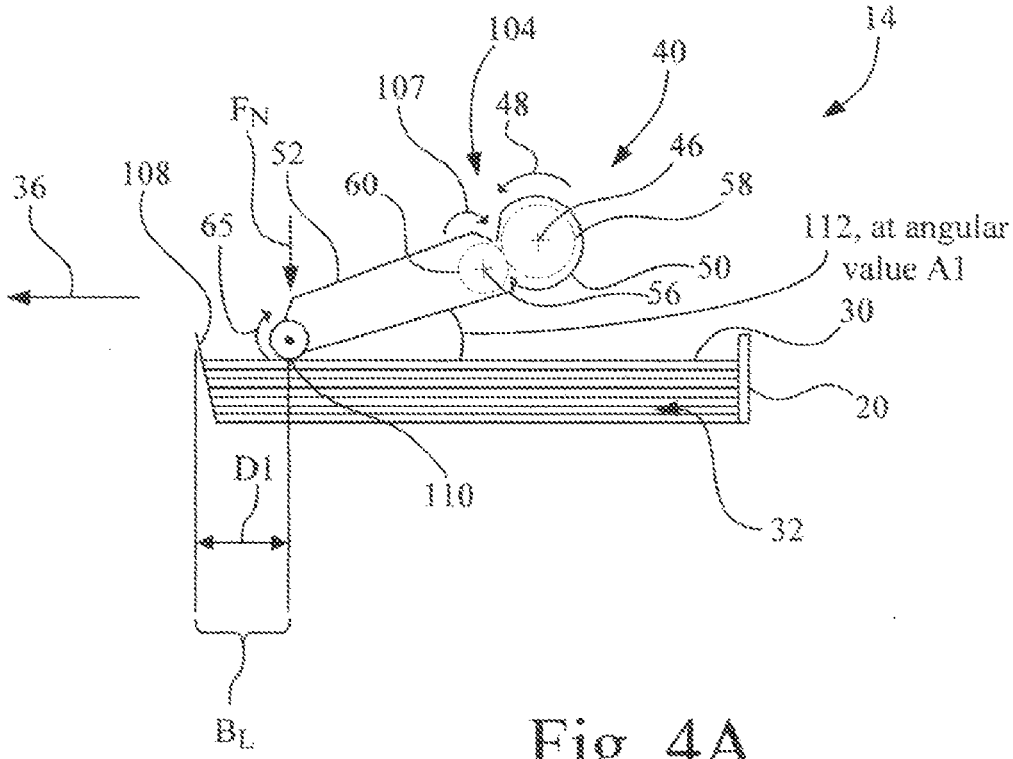
FIGS. 4A and 4B are diagrammatic drawings depicting the auto compensator mechanism of the sheet picking system at the home position and at a non-home position, respectively, and depicting the change in buckling length and the change in the angle of the second housing arm relative to the plane of the sheet of media being picked, during a sheet picking operation.
Figure 4B:
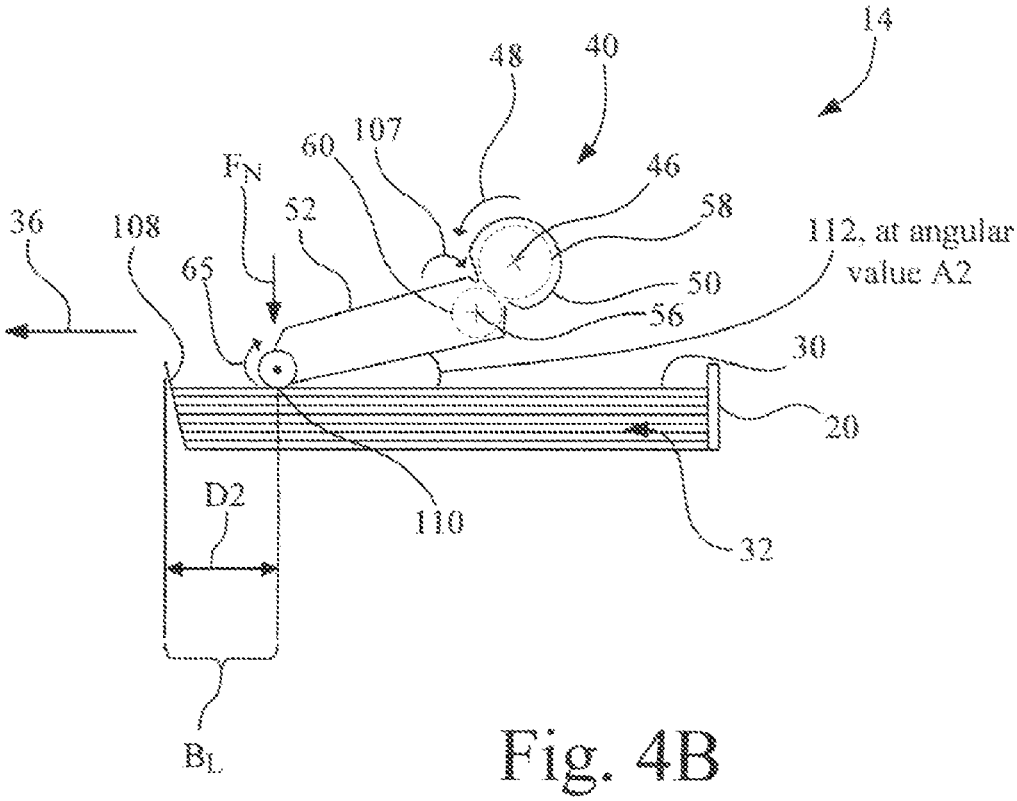

Referring now also to the diagrammatic drawings of FIGS. 4A and 4B, during a sheet picking operation, rotation of driveshaft 44 in rotational direction 48 results in a corresponding rotation of auto compensator mechanism 40 in rotational direction 48, with pick roller 64 asserting a normal force $F_N$ to the top sheet of media, e.g., the sheet of media 30, in media stack 32. The normal force $F_N$ increases until the sheet, of media 30 begins to move in sheet, feed direction 36, thereby overcoming the fictional forces between the sheet of media 30 and the subsequent sheet of media in media stack 32 and the sheet buckling resistance provided along sheet feed path 34 by a sheet buckler 108. Spring 100 (see FIG. 2A) controls the normal force $F_N$ applied to the sheet of media 30 by pick roller 64 as second housing arm 52 is pivoted away from home position 104 during the picking of the sheet of media 30, as shown in FIG. 4B.

As is known in the art, sheet buckler 108 aids in separating the picked sheet, e.g., the sheet, of media 30, from the subsequent sheet of media in media stack 32. Sheet buckler 108 is located downstream of a nip 110 defined by pick roller 64. In accordance with an aspect of the present invention, nip 110 is spaced from sheet buckler 108 by a variable buckling length $B_L$. For example, as shown in FIG. 4A, nip 110 is spaced at a first distance D1 from sheet buckler 108 when second housing arm 52 is at home position 104 relative to first, housing arm 50 (see also FIGS. 2A and 2B). Also, in accordance with an aspect of the present invention, second housing arm 52 is oriented at a variable angle 112 relative to the plane of the sheet of media 30, and when second housing arm 52 is at home position 104 relative to first housing arm 50, angle 112 has an angular value A1, e.g., about 30 degrees in this example.

However, as shown in FIG. 4B, as first housing arm 50 continues to rotate downwardly in rotational direction 48 during a picking of the sheet of media 30, nip 110 is automatically spaced from sheet buckler 108 by a variable second distance D2 greater than first distance D1 as second housing arm 52 is pivoted away from home position 104 (see also FIG. 3), which in turn increases the buckling length $B_L$. Spring 100 (see FIG. 2A) controls the normal force $F_N$ applied to the sheet of media 30 by pick roller 64 as second housing arm 52 is pivoted away from home position 104 during the picking of the sheet of media 30. As second housing arm 52 is pivoted away from home position 104, angle 112 decreases, e.g., to an angular value A2 that is less than angular value A1, e.g., to about 25 degrees in this example.

Thus, with the configuration of auto compensator mechanism 40 as described above, the angle 112 of second housing arm 52 relative to the plane of the sheet of media 30 on media stack 32 decreases as the buckling length $B_L$ increases, increasing the buckling length $B_L$ and decreasing the angle 112 of second housing arm 52 relative to the sheet of media 30 is particularly advantageous when picking relatively stiff media from the media stack 32, since this tends to retard the increase in the normal force $F_N$ exerted by pick roller 64 to the top sheet of media, e.g., the sheet of media 30, in media, stack 32 while increasing the buckling length $B_L$ in which buckling of the sheet of media 30 can occur.

Accordingly, auto compensator mechanism 40 automatically adjusts the buckling length $B_L$ of the sheet of media 3D it auto compensator mechanism 40 tries to drive a stiffer/thicker media, e.g., card-stock, envelopes, and index cards, etc. Also, the normal force $F_N$ applied by the auto compensator mechanism 40 on the media stack 32 each time auto compensator mechanism 40 needs to drive a high buckling resistance (e.g., stiff/thick) media will also be minimized by automatically orienting second housing arm 52 at a smaller angle 112 relative to the sheet of media being picked from media stack 32, and using spring 100 for effectively controlling the needed normal force $F_N$ on media stack 32.

The spring force of spring 100 may be selected, if desired, so that spring 100 will only actuate. i.e., extend, when auto compensator mechanism 40 is driving stiffer/thicker media, or when, auto compensator mechanism 40 meets a higher resistance strong enough to actuate spring 100. In other words, the spring force of spring 100 may be selected to be enough so as not to actuate during feeding of lighter media (e.g. 16 lb and 20 lb paper) in order to avoid multiple feeds.

Figure 4C:
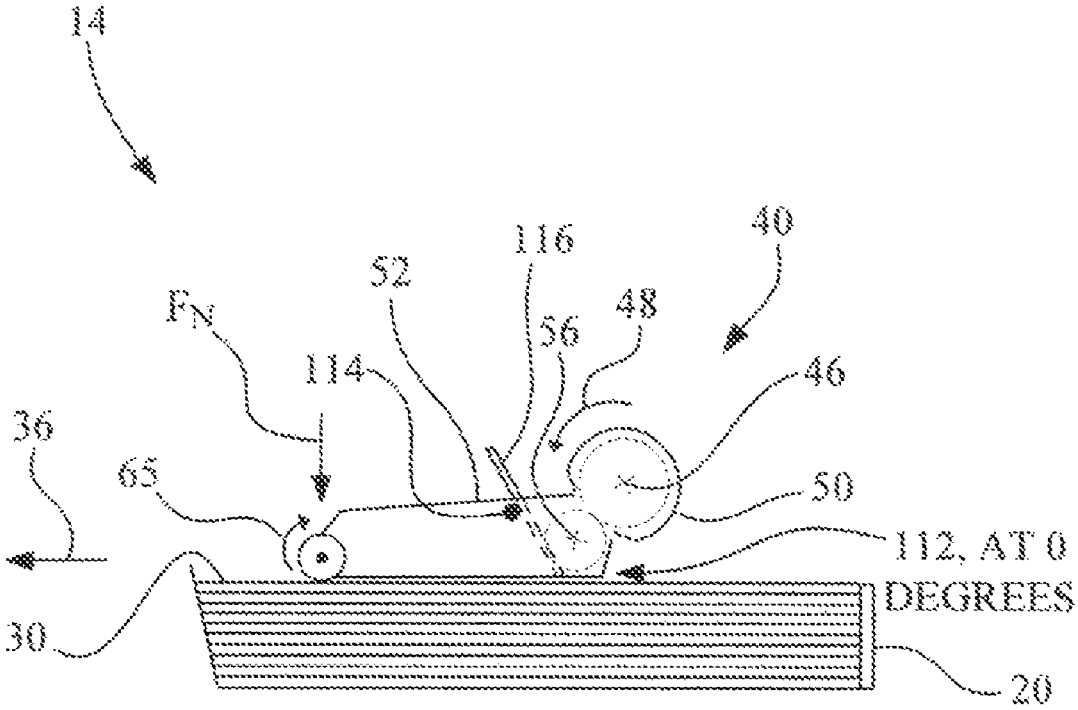
FIG. 4C is a diagrammatic drawing showing an optional limner that limits, the pivot angle of the second housing arm.

As shown, in FIG. 4C, depicting a foil supply tray 20, an optional limiter 114 associated with second housing arm 52 may be positioned to engage a frame 116 of imaging apparatus 10 to limit the pivot angle 112 of second housing arm 52 from full stack to empty stack in supply tray 20. In the present embodiment, pivot angle 112 is prevented by limiter 114 and frame 116 from becoming a negative angle. Accordingly, limiter 114 may be located to prevent auto compensator mechanism 40 from rotating to a negative angle at paper tray levels where a portion of second housing arm 52 may touch the top sheet of media in media stack 32, thereby causing additional resistance. With limiter 114, the change in buckling length $B_L$ from the top of the media stack to the bottom of the media stack increases. For example, in one application, when supply tray 20 is full auto compensator mechanism 40 may increase the buckling length $B_L$ of the media up to 10 millimeters (mm), but for supply tray 20 being one-fourth full to empty the increase of in buckling length $B_L$ may be up to 30 mm. Thus, auto compensator mechanism 40 automatically adjusts the buckling length $B_L$ of the sheet of media and simultaneously and effectively controls the corresponding normal (reaction) force $F_N$ on media stack 32 for different levels (heights) of media in supply tray 20.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the at to which this invention pertains and which fall within the limits of the appended claims.

What is claimed is:

1. A sheet picking system for picking a sheet of media, comprising:

a power source having a driveshaft;

a first housing arm containing a drive gear drivably coupled to said driveshaft, said drive gear defining a first pivot axis for said first housing arm, said drive gear being driven by said driveshaft to rotate about said first pivot axis;

a second housing arm containing an intermediate gear, a transmission device, and a pick roller, said transmission device being configured to rotatably couple said intermediate gear to said pick roller, said intermediate gear being positioned to be directly meshed with said drive gear, said intermediate gear defining a second pivot axis for said second housing arm; and a link mechanism pivotably coupling said first housing arm at said first, pivot axis to said second housing arm at said second pivot axis;

wherein said link mechanism includes an elongate member having a proximal end, a distal end, and an intermediate portion located between said proximal end and said distal end;

said elongate member forms a first pivot joint with said first housing arm near said proximal end at said first pivot axis;

said elongate member forms a second pivot joint with said second housing arm in said intermediate portion at said second pivot axis; and said elongate member defines a cantilever beam located at said distal end, and said second housing arm includes a protrusion member, said cantilever beam having a cam surface, said protrusion member being located to engage said cam surface and deflect said cantilever beam, to provide a rotational resistance when said second housing arm is pivoted at said second pivot axis.

2. The sheet picking system of claim 1, wherein said transmission device includes a plurality of meshed gears.

3. The sheet picking system of claim 1, wherein said transmission device includes an auxiliary driveshaft.

4. The sheet picking system of claim 1, wherein said cantilever beam is separated from said intermediate portion by a gap, and further comprising a compression spring positioned in said gap in contact with said cantilever beam and said intermediate portion of said elongate member.

5. The sheet picking system of claim 1, said first housing arm having a stop surface. and further comprising a spring coupled to said first housing arm and said second housing arm to bias said second housing arm toward said stop surface of said first housing arm, said stop surface defining a home position of said second housing arm relative to said first housing arm.

6. The sheet picking system of claim 5, further comprising an elastic dampener located between said second housing and said stop surface.

7. The sheet picking system of claim 5, wherein said spring controls a normal force applied to said sheet of media by said pick roller as said second housing arm is pivoted away from said home position during a picking of said sheet of media.

8. The sheet picking system of claim 1, further comprising a sheet buckler that is located downstream of a nip defined by said pick roller, said nip being spaced from said sheet buckler by a variable buckling length, said nip being spaced a first distance from said sheet buckler when said second housing arm is at a home position relative to said first housing arm, and said nip being spaced from said sheet buckler by a second distance greater than said first distance as said second housing arm is pivoted away from said home position during a picking of said sheet of media to increase said buckling length.

9. A sheet picking system for picking a sheet of media, comprising:

a power source having a driveshaft;

a first housing arm containing a drive gear drivably coupled to said driveshaft, said drive gear defining a first pivot axis for said first housing arm, said drive gear being driven by said driveshaft to rotate about said first pivot axis;

a second housing arm containing an intermediate gear, a transmission device, and a pick roller, said transmission device being configured to rotatably couple said intermediate gear to said pick roller, said intermediate gear being positioned to be directly meshed with said drive gear, said intermediate gear defining a second pivot axis for said second housing arm;

a link mechanism pivotably coupling said first housing arm at said first, pivot axis to said second housing arm at said second pivot axis; and a sheet buckler that is located downstream of a nip defined by said pick roller, said nip being spaced from said sheet buckler by a variable buckling length, said nip being spaced a first distance from said sheet buckler when said second housing arm is at a home position relative to said first housing arm, and said nip being spaced from said sheet buckler by a second distance greater than said first distance as said second housing arm is pivoted away from said home position during a picking of said sheet of media to increase said buckling length, wherein an angle of said second arm relative to said sheet of media decreases as said buckling length increases.

10. The sheet picking system of claim 9, wherein said first housing arm has a stop surface, and the system further comprises a spring coupled to said first housing arm and said second housing arm to bias said second housing arm toward said stop surface of said first housing arm, said stop surface defining a home position of said second housing arm relative to said first housing arm, said spring controls a normal force applied by said pick roller to said sheet of media at said nip as said, buckling length, increases.

11. An imaging apparatus, comprising:

a media transport system configured to transport a sheet of media along a sheet feed path:

an imaging engine located along said sheet feed path; and a sheet picking system configured to pick said sheet of media from a media stack and transport, said sheet of media to said media transport system, said sheet picking system including:

a power source having a driveshaft;

a first housing arm containing a drive gear drivably coupled to said driveshaft, said drive gear defining a first pivot axis for said first housing arm, said drive gear being driven by said driveshaft to rotate about said first pivot axis;

a second housing arm containing an intermediate gear, a transmission device, and a pick roller, said transmission device being configured to rotatably couple said intermediate gear to said pick roller, said intermediate gear being positioned to be directly meshed with said drive gear, said intermediate gear defining a second pivot axis for said second housing arm; and a link mechanism pivotably coupling said first housing arm at said first pivot axis to said second housing arm at said second pivot axis;

wherein said link mechanism includes an elongate member having a proximal end, a distal end, and an intermediate portion located between said proximal end and said distal end, wherein:

said elongate member forms a first pivot joint with said first housing arm near said proximal end at said first pivot axis;

said elongate member forms a second, pivot joint with said second housing arm in said intermediate portion at said second pivot axis; and said elongate member defines a cantilever beam located at said distal end, and said second housing arm includes a protrusion member, said cantilever beam having a cam surface, said protrusion member being located to engage said cam surface and deflect said cantilever beam to provide a rotational resistance when said second housing arm is pivoted at said second pivot axis.

12. The imaging apparatus of claim 11, wherein said cantilever beam is separated from said intermediate portion by a gap, and further comprising a compression spring positioned in said gap in contact with said cantilever beam and said intermediate portion of said elongate member.

13. The imaging apparatus of claim 11, said first housing arm having a stop surface. and further comprising a spring coupled to said first, housing arm and said second housing arm to bias said second housing arm toward said stop surface of said first housing arm, said stop surface defining a home position of said second housing arm relative to said first housing arm.

14. The imaging apparatus of claim 13, further comprising an elastic dampener located between said second housing and said stop surface.

15. The imaging apparatus of claim 13, wherein said spring controls a normal force applied to said sheet of media by said pick roller as said second housing arm is pivoted away from said home position during a picking of said sheet of media.

16. The imaging apparatus of claim 11, further comprising a sheet buckler that is located downstream of a nip defined by said pick roller, said nip being spaced from said sheet buckler by a variable buckling length, said nip being spaced a first distance from said sheet buckler when said second housing arm is at a home position relative to said first housing arm, and said nip being spaced from said sheet buckler by a second distance greater than said first distance as said second housing arm is pivoted away from said home position during a picking of said sheet of media to increase said buckling length.

17. An imaging apparatus, comprising:

a media transport system configured to transport a sheet of media along a sheet feed path;

an imaging engine located along said sheet feed path; and a sheet picking system configured to pick said sheet of media from a media stack and transport, said sheet of media to said media transport system, said sheet picking system including;

a power source having a driveshaft;

a first housing arm containing a drive gear drivably coupled to said driveshaft, said drive gear defining a first pivot axis for said first housing arm, said drive gear being driven by said driveshaft to rotate about said first pivot axis;

a second housing arm containing an intermediate gear, a transmission device, and a pick roller, said transmission device being configured to rotatably couple said intermediate gear to said pick roller, said intermediate gear being positioned to be directly meshed with said drive gear, said intermediate gear defining a second pivot axis for said second housing arm;

a link mechanism pivotably coupling said first housing arm at said first pivot axis to said second housing arm at said second pivot axis; and a sheet buckler that is located downstream of a nip defined by said pick roller, said nip being spaced from said sheet buckler by a variable buckling length, said nip being spaced a first distance from said sheet buckler when said second housing arm is at a home position relative to said first housing arm, and said nip being spaced from said sheet buckler by a second distance greater than said first distance as said second housing arm is pivoted away from said home position during a nicking of said sheet of media to increase said buckling length, wherein an angle of said second arm relative to said sheet of media decreases as said buckling length increases.

18. The imaging apparatus of claim 17, wherein said first housing arm includes a stop surface, and the sheet picking system further comprises a spring coupled to said first housing arm and said second housing arm to bias said second housing arm toward said stop surface of said first housing arm, said stop surface defining a home position of said second housing arm relative to said first housing arm, said spring controls a normal force applied by said pick roller to said sheet of media at said nip as said buckling length increases.

19. An imaging apparatus, comprising:

a media transport system configured to transport a sheet of media along a sheet feed path;

an imaging engine located along said sheet feed path; and a sheet picking system configured to pick said sheet of media from a media stack and transport, said sheet of media to said media transport system, comprising a power source;

a first housing arm operatively coupled to the power source; and a second housing arm operatively coupled to the first housing arm and having a pick roller, the second housing arm forming an angle relative to the sheet of media disposed below the second housing arm, wherein the angle decreases with continued rotation of the second housing arm relative to the first housing arm during a sheet pick operation.

20. The imaging apparatus of claim 19, wherein the sheet picking system further comprises a stop member which sets a minimum angle of the second housing arm relative to the sheet of media.

21. The imaging apparatus of claim 19, wherein the second housing arm includes a protrusion defined along a surface thereof, and the sheet picking system further comprises an elongated member coupled to the first housing arm at an end portion of the elongated member and coupled to the second housing arm, a portion of the elongated member defining a beam having a cam shaped surface such that engagement of the protrusion of the second housing arm with the cam shaped surface of the beam presents resistance to rotation of the second housing arm relative to the first housing arm.

* * * * *